US009021953B2

(12) United States Patent
Barthram et al.

(10) Patent No.: US 9,021,953 B2
(45) Date of Patent: May 5, 2015

(54) SECURITY DEVICE AND ITS PRODUCTION METHOD

(75) Inventors: Anita Barthram, Berkshire (GB); Matthew Charles Sugdon, Hampshire (GB)

(73) Assignee: De la Rue International Limited, Basingstoke (GB)

( * ) Notice: Subject to any disclaimer, the term of this patent is extended or adjusted under 35 U.S.C. 154(b) by 1820 days.

(21) Appl. No.: 10/536,181

(22) PCT Filed: Nov. 6, 2003

(86) PCT No.: PCT/GB03/04795

§ 371 (c)(1),
(2), (4) Date: Jun. 14, 2005

(87) PCT Pub. No.: WO2004/050376

PCT Pub. Date: Jun. 17, 2004

(65) Prior Publication Data

US 2005/0279235 A1 Dec. 22, 2005

(30) Foreign Application Priority Data

Dec. 4, 2002 (GB) ..... 0228303.4

(51) Int. Cl.
*B41F 33/00* (2006.01)
*B41F 31/00* (2006.01)
*B41M 3/14* (2006.01)

(52) U.S. Cl.
CPC ..... *B41M 3/144* (2013.01)

(58) Field of Classification Search
USPC ..... 101/483, 491
See application file for complete search history.

(56) References Cited

U.S. PATENT DOCUMENTS

| | | | | | |
|---|---|---|---|---|---|
| 4,255,513 | A | * | 3/1981 | Laridon et al. | 430/281.1 |
| 4,520,063 | A | * | 5/1985 | Simon et al. | 428/195.1 |
| 4,897,300 | A | | 1/1990 | Boehm | |
| 4,927,180 | A | | 5/1990 | Trundle et al. | |
| 5,005,873 | A | * | 4/1991 | West | 283/92 |
| 5,425,978 | A | | 6/1995 | Berneth et al. | |
| 6,013,307 | A | * | 1/2000 | Hauser et al. | 427/7 |
| 6,303,213 | B1 | | 10/2001 | Berneth et al. | |

(Continued)

FOREIGN PATENT DOCUMENTS

| | | |
|---|---|---|
| CN | 1117927 A | 3/1998 |
| DE | 23 47 836 | 4/1975 |
| DE | 42 36 143 A1 | 4/1994 |

(Continued)

OTHER PUBLICATIONS

European Patent Office, The Extension of the Deadline for the Conversion of Drivers' License to Credit Card Format, Feb. 28, 2003.

(Continued)

*Primary Examiner* — Ren Yan
(74) *Attorney, Agent, or Firm* — Oliff PLC

(57) ABSTRACT

A security device comprises two or more regions (1, 2). Each region (1, 2) contains a material or combination of materials wherein the two or more regions exhibit substantially the same visible appearance under first viewing conditions and different visible appearances under second viewing conditions, the second viewing conditions. The second viewing conditions comprise a combination of a) visible light and b) substantially any UV wavelength.

28 Claims, 4 Drawing Sheets

(56) References Cited

U.S. PATENT DOCUMENTS

| | | | | |
|---|---|---|---|---|
| 7,108,286 | B1 * | 9/2006 | Weder et al. | 283/72 |
| 2003/0005303 | A1 * | 1/2003 | Auslander et al. | 713/176 |

FOREIGN PATENT DOCUMENTS

| | | | |
|---|---|---|---|
| DE | 199 14 880 | A1 | 10/2000 |
| DE | 698 04 113 | T2 | 3/2002 |
| EP | 0 253 543 | A1 | 1/1988 |
| EP | 0 327 788 | B1 | 8/1988 |
| EP | 0428828 | A1 | 5/1991 |
| EP | 0 603 117 | A1 | 6/1994 |
| EP | 0 996 099 | A2 | 4/2000 |
| EP | 1 036 665 | A1 | 9/2000 |
| EP | 1 179 808 | A1 | 2/2002 |
| EP | 1 567 358 | B1 | 8/2005 |
| GB | 1 407 065 | | 9/1975 |
| GB | 1407 065 | | 9/1975 |
| GB | 2016370 | A | 9/1979 |
| GB | 2300596 | A * | 11/1996 |
| GB | 0228303.4 | | 11/2003 |
| WO | WO 95/13597 | | 5/1995 |
| WO | WO 98/40223 | | 9/1998 |
| WO | WO 98/49016 | A1 | 11/1998 |
| WO | WO 99/14055 | | 3/1999 |
| WO | WO 00/78556 | A1 | 12/2000 |
| WO | 02/068736 | A1 | 9/2002 |

OTHER PUBLICATIONS

European Patent Office, European Office Action for EP 03772406.9, dated Jul. 28, 2009, pp. 1-6.

European Patent Office, European Office Action for EP 03772406.9, dated Jul. 28, 2009, pp. 1-4.

European Patent Office, Appendix for EP 03772406.9, dated Jul. 23, 2009, p. 1.

* cited by examiner

SECURITY DEVICE AND ITS PRODUCTION METHOD

BACKGROUND

The present invention relates to a security device (and method for its production) for use for example on security documents and documents of value such as banknotes, cheques, bonds, certificates, fiscal stamps, tax stamps, vouchers, and brand protection.

It is well known within security printing to use luminescent materials to produce security features. Luminescent materials are known to those skilled in the art to include materials having fluorescent or phosphorescent properties. It is also well known to use other materials that respond visibly to invisible radiation such as photochromic materials and thermochromic materials.

An example of a luminescent feature utilised within security printing can be found in EP-A-253543. This case describes a lustrous metallic ink having differing appearances in visible and UV light. Such metallic fluorescent inks have proved very successful and are widely used on security documents. They provide a metallic ink clearly visible to the public with the additional security that fluorescence provides. The ink is typically printed in a discreet area and has a single colour under UV illumination.

A different type of feature is described in GB-A-1407065, which makes use of metamerism. The case describes the use of metameric pairs of inks appearing essentially the same under a first illuminant, such as natural sunlight, but different under a second illuminant having a different spectral energy distribution, for example produced by a tungsten filament lamp. The embodiments described within the patent are all designed to display metameric properties under differing visible light conditions.

WO-A-9840223 describes a method of printing an image that is invisible under normal lighting conditions but visible under UV illumination. The image visible under UV illumination comprises at least two different colours. The image visible under UV illumination may be the same as another image visible elsewhere on the document under normal lighting condition e.g. a portrait or photograph. It is a requirement of this case that the image viewable under UV illumination is not visible under normal lighting conditions, indeed the inks used are said to be invisible.

WO-A-0078556 describes a security document having both visible and invisible information characterised in that the invisible information is personalised. Particular examples are cited as printing invisible bar codes onto driving licences, passports and other documents intended to confirm a persons identity.

EP-A-1179807 describes an anti-fraud device for documents consisting of a support and at least two printed motifs affixed to the said support, distinguished in that one of the motifs contains an ink that responds to a given wavelength by emitting a specific colour and one other motif contains an ink that reacts to the same wavelength by emitting the same colour but also reacts to a second wavelength by emitting another colour.

EP-A-1179808 describes an anti-fraud device for documents consisting of a support and at least two printed motifs affixed to the said support, distinguished in that one of the motifs contains a first ink that responds to ultraviolet radiation of a given wavelength by emitting a specific colour and one other motif contains a second ink that responds to ultraviolet radiation of the same wavelength by emitting the same colour as the first ink, and the two inks, when subjected to ultraviolet radiation of a second wavelength, emit different colours from each other.

SUMMARY

There is a continuing need to develop security devices whose presence is difficult to ascertain but which, when inspected by someone who knows where to look, are simple to examine, and at the same time are difficult to replicate.

In accordance with a first aspect of the present invention, a security device comprising two or more regions, each region containing a material or combination of materials wherein the two or more regions exhibit substantially the same visible colour under first viewing conditions as hereinbefore defined and different visible colours under second viewing conditions, the second viewing conditions comprising a combination of a) visible light and b) light of substantially any UV wavelength.

In accordance with a second aspect of the present invention, a security device comprising two or more regions, each region containing a material or combination of materials wherein the two or more regions exhibit different visible colours under first viewing conditions as hereinbefore defined and substantially the same visible colours under second viewing conditions, the second viewing conditions comprising a combination of a) visible light and b) light of substantially any UV wavelength.

In accordance with a third aspect a method of providing a security device, the method comprising printing materials on to two or more regions of a substrate, each region containing a material or combination of materials wherein the two or more regions exhibit substantially the same visible colour under first viewing conditions as hereinbefore defined and different visible colours under second viewing conditions, the second viewing conditions comprising a combination of a) visible light and b) light of substantially any UV wavelength.

In accordance with a fourth aspect of the present invention, a method of providing a security device, the method comprising printing materials on to two or more regions of a substrate, each region containing a material or combination of materials wherein the two or more regions exhibit different visible colours under first viewing conditions as hereinbefore defined and substantially the same visible colour under second viewing conditions, the second viewing conditions comprising a combination of a) visible light and b) light of substantially any UV wavelength.

In accordance with a fifth aspect of the present invention, a security device comprising two or more regions, each region containing a material or combination of materials wherein the two or more regions exhibit substantially the same visible colour under first viewing conditions as hereinbefore defined and different visible colours under second viewing conditions, the second viewing conditions comprising a combination of a) visible light and b) infra-red radiation.

In accordance with a sixth aspect of the present invention, a security device comprising two or more regions, each region containing a material or combination of materials wherein the two or more regions exhibit different visible colours under first viewing conditions as hereinbefore defined and substantially the same visible colour under second viewing conditions, the second viewing conditions comprising a combination of a) visible light and b) infra-red radiation.

In accordance with a seventh aspect of the present invention, a method of providing a security device, the method comprising printing materials on to two or more regions of a substrate, each region containing a material or combination of materials wherein the two or more regions exhibit substantially the same visible colour under first viewing conditions as hereinbefore defined and different visible colours under second viewing conditions, the second viewing conditions comprising a combination of a) visible light and b) infra-red radiation.

In accordance with an eighth aspect of the present invention, a method of providing a security device, the method comprising printing materials on to two or more regions of a substrate, each region containing a material or combination of materials wherein the two or more regions exhibit different visible colours under first viewing conditions as hereinbefore defined and substantially the same visible colour under second viewing conditions, the second viewing conditions comprising a combination of a) visible light and b) infra-red radiation.

In this specification, the term "first viewing conditions" means viewing under visible light. Visible light is preferably but not essentially white light which typically includes any of at least north sky light, general indoor light, tungsten light, fluorescent tube light or tri-band fluorescent tube light.

In this specification, the term "region" typically means a region of solid colour or a region made out of elements which are all of the same colour under the appropriate viewing conditions. However, one or more of the regions could be defined by elements such as lines or dots of more than one colour with colour matching under the appropriate viewing conditions being achieved between certain elements of one region and certain elements (or the solid colour) of another region. This will depend upon the extent to which the element within the region can be discerned as presenting a particular colour and in some cases, the region may present an overall solid colour made up of a combination of elements and a background.

By the "same visible colour" we mean that the two regions have the same colour (either as a solid colour or with elements of a particular colour as outlined above) when viewed under the appropriate viewing conditions and with the naked eye.

With this invention, we have developed a new type of security device in which the security property cannot be readily detected because of the need to use invisible UV and/or IR irradiation in connection with one of the viewing conditions but in which the regions exhibit visible colours under both viewing conditions, i.e. colours which are visible to the naked eye. Importantly, in the case of UV, any UV wavelength can be used thus avoiding the problems of the prior art when a narrow band exciting radiation was required.

In this specification, "substantially any UV wavelength" refers to wavelengths between at least 235-380 nm, preferably 200-400 nm. In the case of IR, we envisage wavelengths in the range 750 nm-1 mm.

It should be understood that when viewing under UV or IR, there will be visible light present so that colours visible under visible light also contribute to the overall appearance of each region. Also, in use, only a small is range of UV or IR wavelengths will be used even though, in the case of the UV based materials the region responds to all UV wavelengths.

In some cases, one of the regions will contain a material or materials which exhibit the same visible colour under both sets of viewing conditions. In other, more sophisticated examples, each region will contain a material or materials which exhibit different colours under the different viewing conditions. A particular advantage of the present invention is that it is difficult to determine combinations of materials which provide the required responses since under both sets of illuminating conditions, both the materials within a region will typically influence the resulting colour. Materials envisaged include pigments which are visible, luminescent, thermochromic and/or photochromic.

Typically, the two or more regions are provided on the same side of a substrate such as paper or plastics and are viewed in reflection. However, in a further embodiment of the invention, the regions can be viewed in transmission if the UV or IR source is placed behind the substrate with respect to the observer. If some other complementary visible regions are provided on the front of the substrate with respect to the viewer, both sets of regions will be viewed simultaneously in transmission and reflection respectively. The substrate can be transparent or translucent.

The regions may be spaced apart in different parts of a document, although preferably by no more than 5 mm, or they may abut or even partially overlap.

This leads to a number of further benefits over the existing prior art. There is an increasing-tendency to reduce the size of banknotes and other security documents. This problem has been most notable for security labels and revenue stamps where space for security features is extremely limited. As such, having a feature that requires both an invisible print and visible print to be printed in separate areas is not desirable. The preferred embodiments of the invention in which the regions at least abut overcomes this problem by combining both the visible and invisible elements into a single feature.

An additional benefit was found by using two rainbow printed inks which appear differently coloured in visible light. Sometimes it can be difficult to achieve a perfect colour match between two or more inks. By having an overlap region between the inks the slight difference in visual appearance is reduced to the point where the two inks appear colour matched. Such an effect can also be achieved by suitable use of half-tone or stochastic screens and indeed may employ multiple print processes.

A similar benefit is achieved by rainbow printing inks which appear differently coloured under the second viewing conditions.

The regions may be provided by offset lithography or any other known printing technique such as letterpress, intaglio, screen, digital printing, inkjet etc. Preferably, the regions are printed in a single pass although they could be printed in more than one pass or by a combination of two (or more) processes.

In one example, it has been found that both regions of solid print and/or regions of line work achieve the desired effect when produced in an interlocking type design.

In the current invention it is important to control the mixture of inks/pigments to achieve a correct balance between the desired colour in the visible spectrum and the correct colour under combined visible and invisible illumination.

In some examples, a photochromic material may be used in combination with luminescent materials. A first ink would contain only a fluorescent component whereas a second ink would contain both fluorescent and photochromic components. Here two colours would appear in visible illumination and this would remain the case under combined visible and UV illumination for a short period. As the photochromic material begins to react to the UV light in the second ink the background colour of the second ink changes and alters the fluorescent colour to the point where the two fluorescent colours appear matched.

A similar effect could be achieved using ink containing photochromic and thermochromic components. Here the two inks would appear different colours under UV illumination until the thermochromic ink is activated with heat. Once the thermochromic is activated the two colours would appear matched. Both the thermochromic and the photochromic could be reversible or irreversible. This idea could be taken further by adding photochromic and/or thermochromic components to both inks in combination with the fluorescent pigments. This would allow a wide variety of effects to created where different inks can be cycled through a number of colours before finally being coloured matched.

In some examples, the ink(s) may include a thermochromic component and no UV responsive component.

A number of options are possible when using photochromic and/or thermochromic material. Examples include:

- A device having at least two regions where the first region is printed without any additional functional material. The second region is printed with a second ink containing either a photochromic or thermochromic pigment. The colour of the second region is the same as the first region under visible light illumination but different in the presence of visiabl light illumination combined with prolonged UV illumination for the photochromic or IR illumination for a thermochromic.
- A device having first and second regions printed with inks containing different photochromic materials. The ink is prepared such that the two regions appear the same colour under visible light illumination but different colours in the combined presence of visible light illumination and prolonged UV illumination. It is also possible to produce the reverse effect with the two regions containing photochromic materials to appear different colours under visible light illumination but the same colour in the combined presence of visible light illumination and prolonged UV illumination.
- A device having first and second regions both of which are printed with ink containing luminescent materials. Furthermore, one or both regions also contain a photochromic or thermochromic material. Both regions may contain the same material or different materials. Such a combination would allow for a wide range of viewing conditions.
- Both regions include a luminescent material while one or both of the regions also include a photochromic material (of different types if both regions).

Where photochromic and/or thermochromic materials are not used then a luminescent material (phosphorescent or fluorescent) can be provided in one region or at least two different luminescent materials can be provided in the at least two regions.

In all cases, the choice of materials must be made such that the resultant colours satisfy the above stated requirements of one of the inventive concepts.

The regions may comprise simple geometrical shapes such as squares, rectangles and the like but preferably consists of one or more of graphical patterns, indicia such as alphanumerics, security patterns and images. This reduces the area required for the device since it can be included within the overall pattern of a substrate on which it is provided. The regions may be solid or discontinuous, for example made up of dots, lines etc.

One method of attempting to replicate one embodiment of the feature would be to print background print in non-luminescent inks and then overprint with a single coloured luminescent print. This would not work as the visible pigments would interfere with the colour replay of luminescent pigments and give the effect of two different colours. Similarly an attempt to replicate an embodiment by printing a background in luminescent inks and overprint with a non-luminescent ink would not work.

Security devices according to the invention can be used in a wide variety of applications but are particularly suitable on security documents and documents of value as mentioned above.

The security devices could be provided directly on documents or in the form of transferable labels.

BRIEF DESCRIPTION OF THE DRAWINGS

Examples of security devices according to the present invention will now be described in more detail by reference to the following Figures.

DETAILED DESCRIPTION

Figure 1:
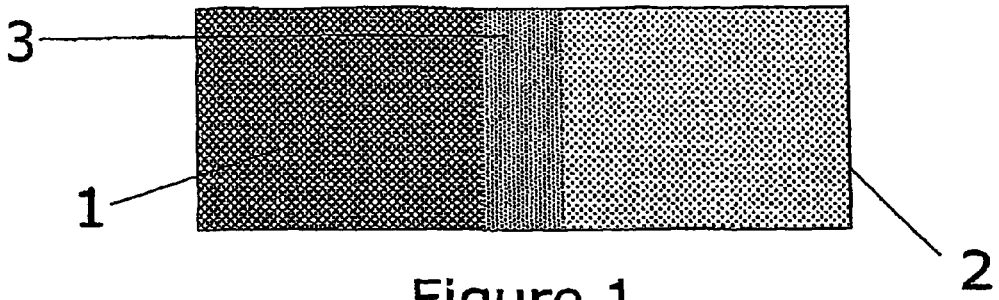
FIG. 1 illustrates a first embodiment of the invention when viewed in visible light.
Figure 2:
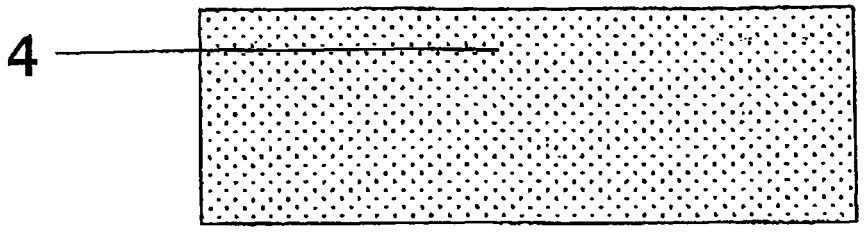
FIG. 2 illustrates a first embodiment of the invention when viewed in a combination of visible light and non-visible illumination.

FIGS. 1 and 2 illustrate a first embodiment of the current invention. FIG. 1 shows the device illuminated under normal visible, typically white, light conditions. Under visible light the observer can clearly see two differently coloured regions (purple 1 and red 2) overlapping in a central region 3. It should be appreciated that in the region 3 where the two colours overlap a third colour may be present due to colour mixing of the first two colours. The first colour 1 comprises one or more visible pigments in combination with at least one luminescent pigment. Likewise the second colour 2 comprises one or more visible pigments and at least one luminescent pigment. In the central region 3 the two inks overlap. Within security print this is usually achieved by a process known as rainbowing. It should however be appreciated that the overlap could also be achieved using multiple printing plates, process, printing screens or any other method known to those skilled in the art. Of course, any known printing method can be used.

When the above print is then viewed under a combination of visible light and invisible, UV, radiation only a single colour, e.g. yellow, is visible to the human eye 4. In order to achieve this a number of factors must be taken into account. For example visible pigments affect the emission colour of the luminescent pigment in invisible radiation and the pigment body colour of the luminescent pigments may affect the colour of the visible pigments under visible light. As a result care must be taken when preparing the inks to ensure the desired effect can be achieved.

Figure 3:
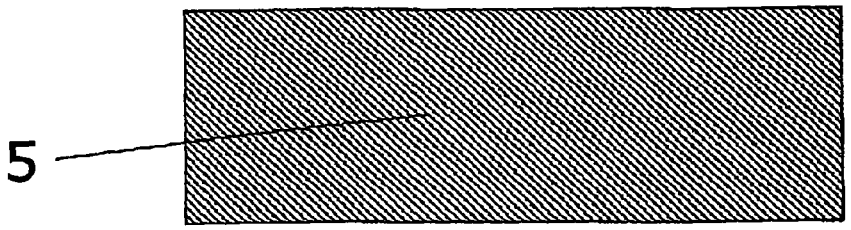
FIG. 3 illustrates a second embodiment of the invention when viewed in visible light.
Figure 4:
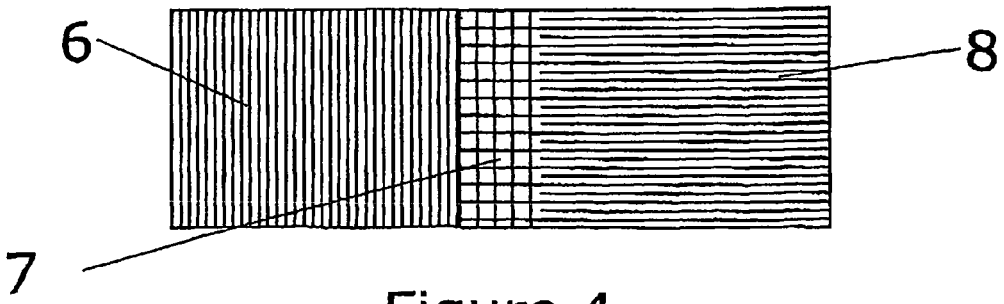
FIG. 4 illustrates a second embodiment of the invention when viewed in a combination of visible light and non-visible illumination.

Similar care must be taken when implementing the second embodiment illustrated in FIGS. 3 and 4. Here a single colour, brown, is viewable in visible light 5 and when this is then viewed under combined visible light and invisible, UV radiation two coloured regions, red and green, 6,8 become visible. This effect is achieved in a similar manner to the first embodiment with two inks being printed in a manner such that they overlap in at least one portion 7.

Figure 5:
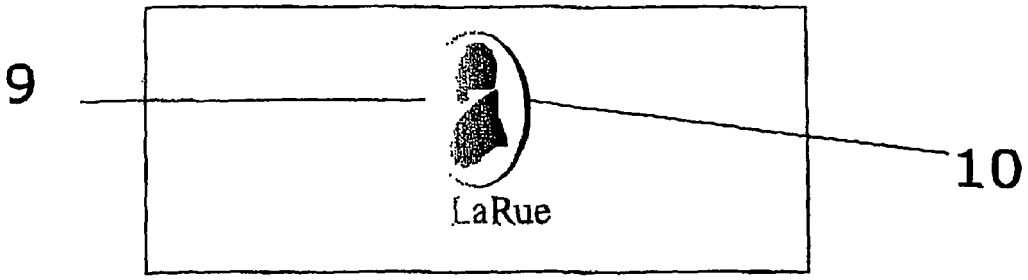
FIG. 5 illustrates a third embodiment of the invention when viewed in visible light.
Figure 6:
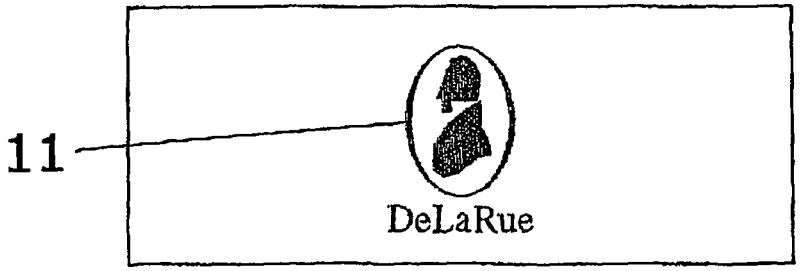
FIG. 6 illustrates a third embodiment of the invention when viewed in a combination of visible light and non-visible illumination.

FIGS. 5 and 6 show a further enhancement to the invention and illustrate how it might be utilised on a document to great effect. Here the two inks 9,10 are printed in such a manner so that where they overlap a visual device is created. In this example the device is a company logo but any form of indicia, logo, identifying information, numerical data or text could be used, this is simply a matter of design choice. As can clearly be seen from FIG. 5 the first ink 9 defines the left half of the logo whilst the second ink 10 defines the right half of the logo. Under visible light the device appears as two colours (red and yellow) overlapping in a central region (FIG. 5). When the device is illuminated under combined visible light and invisible, UV radiation the device appears as single colour (red) 11. This colour may be the same as one of the first two colours but is preferably different. The device offers a very strong visual confirmation as to the validity of the document.

These embodiments make it easy for the viewer by locating both the invisible and visible information in the same place.

Figure 7:
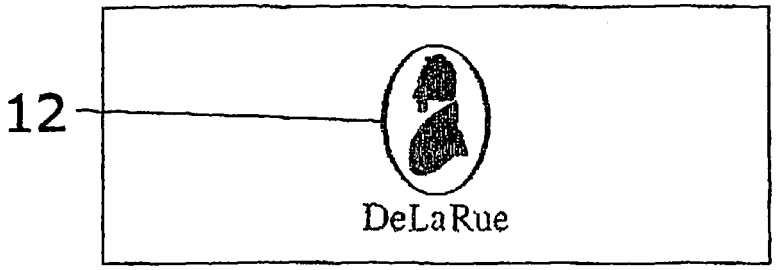
FIG. 7 illustrates a fourth embodiment of the invention when viewed in visible light.
Figure 8:
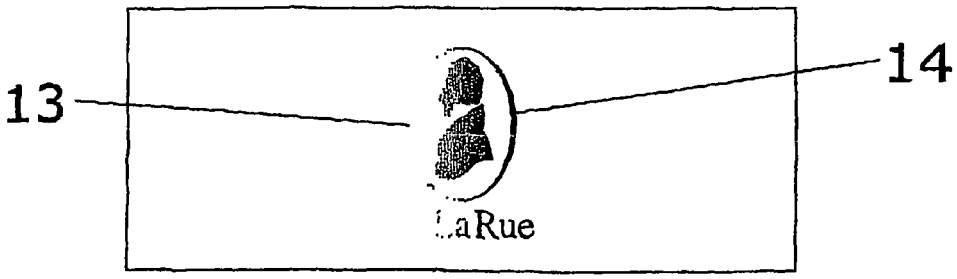
FIG. 8 illustrates a fourth embodiment of the invention when viewed in a combination of visible light and non-visible illumination.

FIGS. 7 and 8 illustrate a further embodiment again making use of a company logo. Here a single visible colour or tone (red) 12 under visible light becomes two colours (red, green) 13,14 when illuminated using combined visible and invisible, UV radiation.

Figure 9:
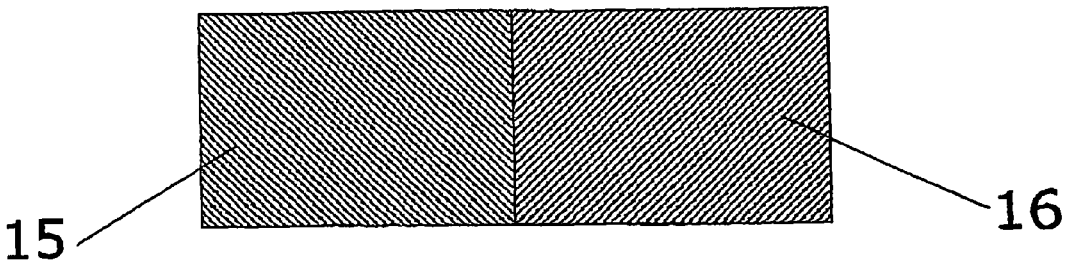
FIG. 9 illustrates a fifth embodiment of the invention when viewed in visible light illumination.
Figure 10:
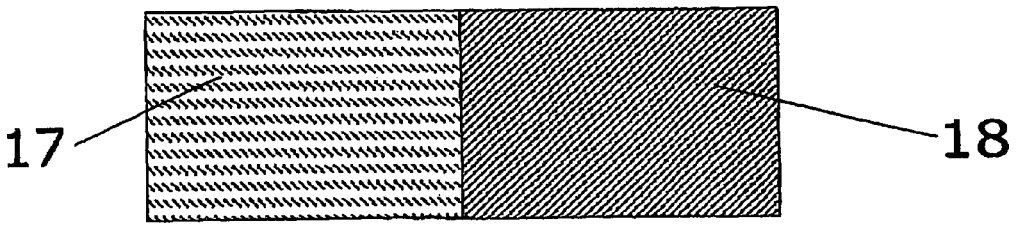
FIG. 10 illustrates a fifth embodiment of the invention when viewed initially in a combination of visible light and invisible illumination.
Figure 11:
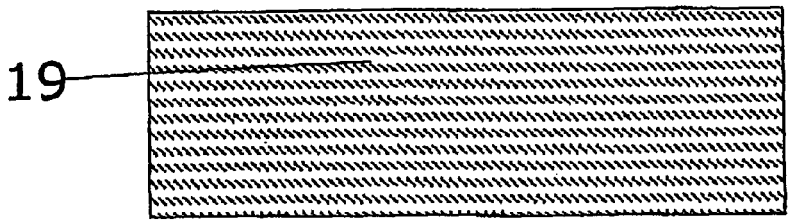
FIG. 11 illustrates a fifth embodiment of the invention when viewed after prolonged visible light and invisible illumination.

FIGS. 9, 10 and 11 illustrate an alternative embodiment combining both luminescent materials and another colour effect material such as a material showing photochromism or thermochromism. Considering first the combination of luminescent materials with a UV excitable photochromic material, FIG. 9 shows the device illuminated under visible light only where two colours (green and yellow) 15,16, are visible. FIG. 10 shows the same device after initial illumination under combined visible light and UV radiation where the viewer will still see two colours (orange and yellow) 17,18 though these will preferably be different to those viewed in visible light. Finally, FIG. 11 shows the device after prolonged exposure to combined visible light and UV light where now only a single colour (orange) can be seen 19. The effect is achieved by combining a photochromic pigment with the luminescent pigment and visible pigment in one of the inks. In this example a first ink 15 contains both visible pigments and luminescent pigments as described previously. The second ink 16 however contains visible pigments, luminescent pigments and photochromic pigments. In this example the photochromic pigment changes from invisible to visible after several seconds of exposure to combined visible and UV light. When exposed to visible light only neither the luminescent pigments nor the photochromic pigment is activated and the viewer only visualises the visible pigments. After initial exposure to combined visible and UV light the viewer will see the colour resulting from the luminescent pigments. This colour is altered to an extent by the background colour as before. After prolonged exposure to visible and UV light the photochromic pigment reacts and changes colour. This causes a change in the background colour which has an effect on the appearance of the luminescent colour. If this is carefully controlled the change in background colour can be such as to make the luminescent colour match that of the first ink.

A similar effect can be created by substituting the photochromic with a thermochromic. Here the second colour change is effected by heating the document. The heat may come from an external source of IR radiation or by the viewers hand, breath etc. In this case, UV irradiation is also continued.

Figure 12A:
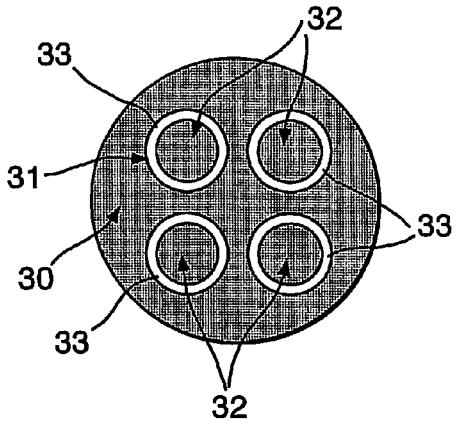
FIGS. 12A and 12B illustrate a sixth embodiment of the invention when viewed in visible light and combined visible light and invisible illumination respectively; and, FIGS. 13A and 13B are views similar to FIGS. 12A and 12B but of a seventh embodiment.
Figure 12B:
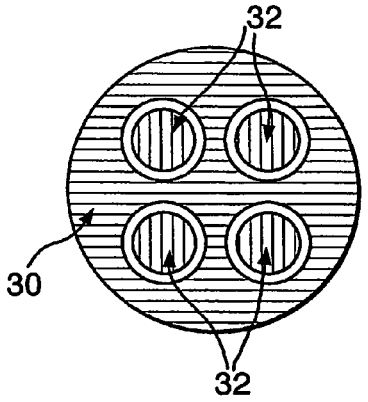

FIGS. 12A and 12B illustrate a sixth embodiment in which there is a circular background region 30 having a number of circular unprinted regions 31 within it. Within each unprinted region 31 is provided a respective second region 32 with a smaller diameter than the region 31 so that there is an unprinted ring 33 defined between the regions 30,32. Typical outer dimensions of the device shown in FIG. 12A is 20 mm. The unprinted regions 31 in the form of rings may have a radial dimension of about 0.5 mm.

Although the regions 31 are unprinted in this example, they may be filled in with a further print working or as a further alternative the device may be printed onto a background visible within the regions 31.

Under visible light, the printed regions 30,32 have the same visible appearance. Under combined visible light and UV irradiation (FIG. 12B) the region 30 luminesces in a different visible colour to the visible colour with which the regions 32 luminesce.

Figure 13A:
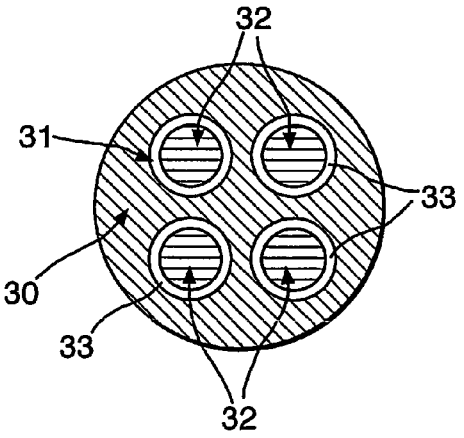
Figure 13B:
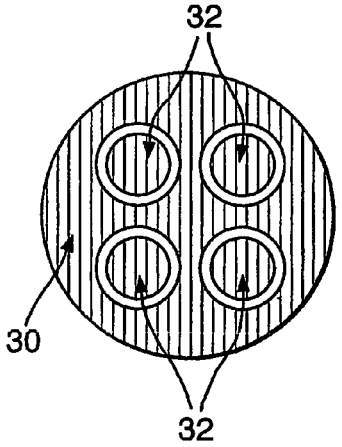

FIGS. 13A-13B illustrate an alternative approach to that of FIG. 12. Thus, in this case, the regions 30,32 present different colours when illuminated with visible light (FIG. 13A) but, when irradiated with a combination of visible light and UV illumination, they each luminesce such that the resultant colours from each region are substantially the same.

In all the previous examples, a luminescent material has been included in at least one of the regions. It would be possible instead to use only a photochromic or only a thermochromic material with no luminescent material.

Some examples of suitable ink formulae for use in these embodiments are described below although some adjustments may be necessary as will be readily understood by a person skilled in the art to achieve an acceptable colour match:

| Purple ink luminescing yellow | |
|---|---|
| Sandorin Violet BL (ex Clariant) | 0.78% |
| Permanent Carmine FBB02 (ex Clariant) | 2.58% |
| Scanning Compound 6 (ex Angstrom Technologies) | 30% |
| Lumilux Red CD740 (ex Honeywell) | 2.5% |
| Lithographic printing ink vehicle | 62.5% |
| Antioxidant | 1% |
| Cobalt Driers | 0.64% |
| Red ink luminescing yellow | |
| Sandorin Scarlet 4RF (ex Clariant) | 4.32% |

-continued

| | |
|---|---|
| Novoperm Red F5RK (ex Hoechst) | 0.15% |
| Scanning Compound 6 (ex Angstrom Technologies) | 15% |
| Scanning Compound 4 (ex Angstrom Technologies) | 2.5% |
| Lithographic printing ink vehicle | 76.5% |
| Antioxidant | 1% |
| Cobalt Driers | 0.6% |
| Brown ink luminescing red | |
| Graphtol Yellow RGS (ex Clariant) | 6.1% |
| Graphtol Orange P2R (ex Clariant) | 1.3% |
| Permanent Carmine FBB02 (ex Clariant) | 3.4% |
| Paliogen Black L0084 (ex BASF) | 4.9% |
| Lumilux Red CD740 (ex Honeywell) | 25% |
| Lithographic printing ink vehicle | 39% |
| Antioxidant | 1% |
| Cobalt Driers | 0.7% |
| Brown ink luminescing green | |
| Graphtol Yellow RGS (ex Clariant) | 6.1% |
| Graphtol Orange P2R (ex Clariant) | 1.3% |
| Permanent Carmine FBB02 (ex Clariant) | 3.4% |
| Paliogen Black L0084 (ex BASF) | 4.9% |
| Scanning Compound 4 (ex Angstrom Technologies) | 25% |
| Lithographic printing ink vehicle | 39% |
| Antioxidant | 1% |
| Cobalt Driers | 0.7% |

An example of a photochromic ink is set out below.

| Blue Photochromic Ink | |
|---|---|
| Photochromic pigment prepared by thermosetting the acrylate polymer in the presence of photochromic dye (Photosol 33672, PPG Industries) | 20% |
| Phenolic modified resin | 23.5% |
| Drying oil | 30.5% |
| Alkyd resin | 15.6% |
| High boiling point aliphatic hydrocarbon | 3.4% |
| Wax | 5% |
| Driers | 1% |
| Anti-oxidant | 1% |

The following formulae provide inks which are purple and red under visible light while the red ink turns purple when exposed to combined visible and UV light, the "purple" ink being unchanged in appearance under combined visible and UV light. The purple colours will then match.

| Purple Ink Formula | |
|---|---|
| Sandorin Violet BL (ex Clariant) | 0.78% |
| Permanent Carmine FBB02 (ex Clariant) | 2.58% |
| Lithographic printing ink vehicle | 95% |
| Antioxidant | 1% |
| Cobalt driers | 0.64% |
| Red Ink Formula | |
| Sandorin Scarlet 4RF (ex Clariant) | 4.32% |
| Novoperm Red F5RK (ex Hoechst) | 0.15% |
| Blue photochromic ink described above | 30% |
| Lithographic printing ink vehicle | 63.93% |
| Antioxidant | 1% |
| Cobalt driers | 0.6% |

The following ink formulae will allow an ink which is red under visible light to turn purple when exposed to visible and UV light and match another ink which is purple under visible light and unchanged under visible and UV light. Initially, the fluorescent colours will not match. As the photochromic material changes colour, the fluorescent emission colours will match. When the UV light is removed, the visible colours will match for a period until the photochromic materials start to change back.

| Purple Ink Formula | |
|---|---|
| Sandorin Violet BL (ex Clariant) | 0.78% |
| Permanent Carmine FBB02 (ex Clariant) | 2.58% |
| Scanning compound 6 (ex Angstrom Technologies) | 30% |
| Lumilux Red CD740 (ex Honeywell) | 2.5% |
| Lithographic printing ink vehicle | 62.5% |
| Antioxidant | 1% |
| Cobalt driers | 0.64% |
| Red Ink Formula | |
| Sandorin Scarlet 4RF (ex Clariant) | 4.32% |
| Novoperm Red F5RK (ex Hoechst) | 0.15% |
| Scanning compound 6 (ex Angstrom Technologies) | 30% |
| Lumilux Red CD740 (ex Honeywell) | 2.5% |
| Photochromic ink described previously | 30% |
| Lithographic printing ink vehicle | 31.5% |
| Antioxidant | 1% |
| Cobalt driers | 0.6% |

The invention claimed is:

1. A method of providing a security device, the method comprising printing materials on to two or more regions of a substrate, each region containing a material or combination of materials wherein the two or more regions exhibit substantially the same visible colour under first viewing conditions defined as visible light having a wavelength greater than 380 and less than 750 nm and different visible colours under second viewing conditions, the second viewing conditions comprising a combination of a) the visible light and b) light of substantially any UV wavelength in the range 235-380 nm, wherein the at least two regions each include a homogeneous mix of at least one pigment that luminesces under UV irradiation and at least one pigment that is visible under visible light, and wherein each region exhibits a first colour under visible light and different second colours under the second viewing conditions, and wherein the at least two regions define one or more of graphical patterns, indicia, security patterns and images.

2. A method of providing a security device, the method comprising printing materials on to two or more regions of a substrate, each region containing a material or combination of materials wherein the two or more regions exhibit different visible colours under first viewing conditions defined as visible light having a wavelength greater than 380 and less than 750 nm and substantially the same visible colour under second viewing conditions, the second viewing conditions comprising a combination of a) the visible light and b) light of substantially any UV wavelength in the range 235-380 nm, wherein the at least two regions each include a homogenous mix of at least one pigment that luminesces under UV irradiation and at least one pigment that is visible under visible light, and wherein each region exhibits different first colours under visible light and a different second colour under the second viewing conditions, and wherein the at least two regions define one or more of graphical patterns, indicia, security patterns and images.

3. A security device comprising two or more regions, each region being printed with a material or combination of materials wherein the two or more regions exhibit substantially the same visible colour when viewed under first viewing conditions defined as visible light having a wavelength greater than 380 and less than 750 nm and different visible colours under second viewing conditions, the second viewing conditions comprising a combination of a) the visible light and b) light of substantially any UV wavelength in the range 235-380 nm, wherein the at least two regions each include a homogeneous mix of at least one pigment that luminesces under UV irradiation and at least one pigment that is visible under visible light, and wherein each region exhibits a first colour under visible light and different second colours under the second viewing conditions, and wherein the at least two regions define one or more of graphical patterns, indicia, security patterns and images.

4. A device according to claim 3, wherein at least one region includes a material which is photochromic and which exhibits colour change under UV irradiation.

5. A device according to claim 4, wherein at least two regions include a material or materials which is photochromic and which exhibits a colour change under UV irradiation.

6. A device according to claim 4, wherein at least one region includes a material, for example an ink, which luminesces under UV irradiation and wherein one region includes material(s) which are luminescent and photochromic, and at least one other region includes a luminescent material, whereby under UV and visible light illumination each region initially exhibits a different visible colour while after extended combined illumination, the photochromic material changes colour so that the visible colour of the two regions is substantially the same.

7. A device according to claim 3, wherein the regions are spaced apart.

8. A device according to claim 3, wherein the regions are adjacent or partially overlap.

9. A device according to claim 8, wherein the regions abut one another.

10. A device according to claim 3, the device being provided with the regions on the same side of a substrate.

11. A device according to claim 3, wherein the regions are registered with respect to one another.

12. A device according to claim 3, wherein the regions can be viewed in reflection and transmission.

13. A device according to claim 3, wherein at least one of the regions includes a homogeneous mix of said materials.

14. An article carrying a security device according to claim 3.

15. An article according to claim 14, the article comprising a security document or document of value such as a banknote, identity card, cheque, bond, certificate, fiscal stamp, tax stamp and voucher.

16. A security device comprising two or more regions, each region being printed with a material or combination of materials wherein the two or more regions exhibit different visible colours when viewed under first viewing conditions defined as visible light having a wavelength greater than 380 and less than 750 nm and substantially the same visible colours under second viewing conditions, the second viewing conditions comprising a combination of a) the visible light and b) light of substantially any UV wavelength in the range 235-380 nm, wherein the at least two regions each include a homogenous mix of at least one pigment that luminesces under UV irradiation and at least one pigment that is visible under visible light, and wherein each region exhibits different first colours under visible light and a different second colour under the second viewing conditions, and wherein the at least two regions define one or more of graphical patterns, indicia, security patterns and images.

17. A device according to claim 16, wherein at least one region includes a material, for example an ink, which luminesces under UV irradiation, wherein at least one region includes a material which is photochromic and which exhibits colour change under UV irradiation and wherein one region includes material(s) which are luminescent and photochromic, and at least one other region includes a luminescent material, whereby under UV and visible light illumination each region initially exhibits substantially the same visible colour while after extended combined illumination, the photochromic material changes colour so that the visible colours exhibited by the two regions are different.

18. A device according to claim 16, wherein at least one region includes a material which is photochromic and which exhibits colour change under UV irradiation.

19. A device according to claim 18, wherein at least two regions include a material or materials which is photochromic and which exhibits a colour change under UV irradiation.

20. A device according to claim 16, wherein the regions are spaced apart.

21. A device according to claim 16, wherein the regions are adjacent or partially overlap.

22. A device according to claim 21, wherein the regions abut one another.

23. A device according to claim 16, the device being provided with the regions on the same side of a substrate.

24. A device according to claim 16, wherein the regions are registered with respect to one another.

25. A device according to claim 16, wherein the regions can be viewed in reflection and transmission.

26. A device according to claim 16, wherein the regions define one or more of graphical patterns, indicia, security patterns and images.

27. An article carrying a security device according to claim 16.

28. An article according to claim 27, the article comprising a security document or document of value such as a banknote, identity card, cheque, bond, certificate, fiscal stamp, tax stamp and voucher.

* * * * *